United States Patent [19]

Hohr et al.

[11] Patent Number: 4,955,331

[45] Date of Patent: Sep. 11, 1990

[54] PROCESS FOR THE OPERATION OF AN OTTO ENGINE

[75] Inventors: Dieter Hohr, Wesel; August-Wilhelm Preuss; Kurt-Peter Schug, both of Dorsten; Helmut Riegel, Gelsenkirchen, all of Fed. Rep. of Germany

[73] Assignee: Vebe Oel Aktiengesellschaft, Gelsenkirchen, Fed. Rep. of Germany

[21] Appl. No.: 300,129

[22] Filed: Jan. 23, 1989

[30] Foreign Application Priority Data

Jan. 23, 1988 [DE] Fed. Rep. of Germany ..... 3801947

[51] Int. Cl.[5] ..... F02B 75/12; C10L 10/00

[52] U.S. Cl. ..... 123/1 A; 44/68; 44/69

[58] Field of Search ..... 123/1 A; 44/69, 68

[56] References Cited

U.S. PATENT DOCUMENTS

| | | | |
|---|---|---|---|
| 3,341,311 | 9/1967 | Pedersen | 44/69 |
| 3,410,670 | 11/1968 | Le Suer | 44/57 |
| 4,082,517 | 4/1978 | Niebylski et al. | 44/68 |
| 4,139,349 | 2/1979 | Payne | 44/68 |
| 4,222,746 | 9/1980 | Sweeney et al. | 123/1 A |
| 4,225,174 | 6/1985 | Croudace | 123/1 A |
| 4,389,220 | 6/1983 | Kracklauer | 123/1 A |
| 4,444,565 | 4/1984 | Croudace | 44/68 |
| 4,612,880 | 9/1986 | Brass et al. | 123/1 A |

FOREIGN PATENT DOCUMENTS

| | | |
|---|---|---|
| 2502307 | 7/1975 | Fed. Rep. of Germany . |
| 3715473 | 8/1988 | Fed. Rep. of Germany . |
| 1094786 | 5/1955 | France . |
| 1098800 | 8/1955 | France . |

OTHER PUBLICATIONS

Erdol und Kohle, Erdgas, Petrochemie, 18. Jahrgang, Heft 11 (Nov. 1965), S. 885 bis 893.

Carl Zerbe, Mineralole und verwandte Produkte, erster Teil, Springer-Verlag, Berlin, Heidelberg, New York (1969), S. 600 bis 603, (no month provided).

*Primary Examiner*—E. Rollins Cross

*Attorney, Agent, or Firm*—Oblon, Spivak, McClelland, Maier & Neustadt

[57] ABSTRACT

A method for reducing the consumption of fuel and emission of toxic exhaust gas and reducing engine wear of an Otto engine, equipped with an exhaust gas catalyst system for secondary combustion of exhaust gas, in which a liquid non-leaded fuel containing 1 to 100 ppm by weight of ferrocene is used.

6 Claims, 9 Drawing Sheets

PROCESS FOR THE OPERATION OF AN OTTO ENGINE

BACKGROUND OF THE INVENTION

1. Field of the Invention:

The invention relates to a process for operating an Otto engine, i.e., a spark ignition four-cycle engine equipped with a carburetor, with a non-leaded liquid fuel, containing an addition of 1 to 100, preferably 5 to 20 ppm, by weight of ferrocene.

2. Discussion of the Background:

In recent years, the industrial countries have passed laws to restrict the emissions from internal combustion engines of, in particular, carbon monoxide (CO), nitrogen oxides ($NO_x$) and hydrocarbons ($C_xH_y$) in order to limit environmental pollution that is related to these emissions. Even the lead compounds, for example tetraethyl lead, that are added as knock suppressors to fuels for Otto engines, are subject to increasing restrictions with respect to their use.

The unwanted exhaust gas emissions can be controlled at three different points during the function of the engine. The first point at which the emissions may be affected is the mixture formation stage prior to burning of the fuel. The second point at which the emissions composition may be altered is within the engine itself, for example by effecting specific design changes to optimize the combustion chamber, etc. Finally, the third possibility is an aftertreatment of the exhaust gases as they pass out of the engine following combustion. Typically, a catalytic converter is used to promote the after burning of CO and hydrocarbons to harmless carbon dioxide and water. At the same time, the catalytic converter reduces the oxides of nitrogen present in the exhaust gas to neutral nitrogen. Using a catalytic converter, approximately 90% or more of the toxic carbon monoxide, hydrocarbons and oxides of nitrogen can be converted to harmless materials. Of the solutions developed to clean or reduce car emissions, the catalytic processes have become very important (see Chemist Newspaper, 97 Year 1973, no. 9, p. 469 ff.). The addition of lead to leaded fuels poisons the exhaust gas catalytic converters, however, rendering them ineffective by coating the active centers of the catalytic converter.

Due to the health-impairing effect of lead compounds contained in the combustion exhausts emitted during operation of Otto engines, alternatives have been sought that would exhibit not only the beneficial effect of adding lead compounds, in particular improved antiknock behavior, but also a specific beneficial effect with respect to the wear of the exhaust valves of four cycle Otto engines.

Thus blends of liquid hydrocarbon, containing primarily gasoline and an organometal compound selected from the group of dicyclopentadienyl iron (ferrocene) and gasoline-soluble derivatives, have been proposed to reduce the consumption of fuel and the pollution from exhaust as well as to eliminate or reduce the carbon deposits, where such blends also contain the usual antiknock additives (see DE-OS 25 02 307).

SUMMARY OF THE INVENTION

Accordingly, one object of the present invention is to provide a method for operating an Otto engine equipped with a catalytic converter with a reduction in fuel consumption and exhaust emissions and reduced wear of the exhaust valves of the engine.

It has been found that Otto engines, equipped with an exhaust gas catalyst system in the exhaust system for secondary combustion of exhaust gas, can be operated with an unleaded fuel to which ferrocene has been added, such that the effect of the catalyst system is improved.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
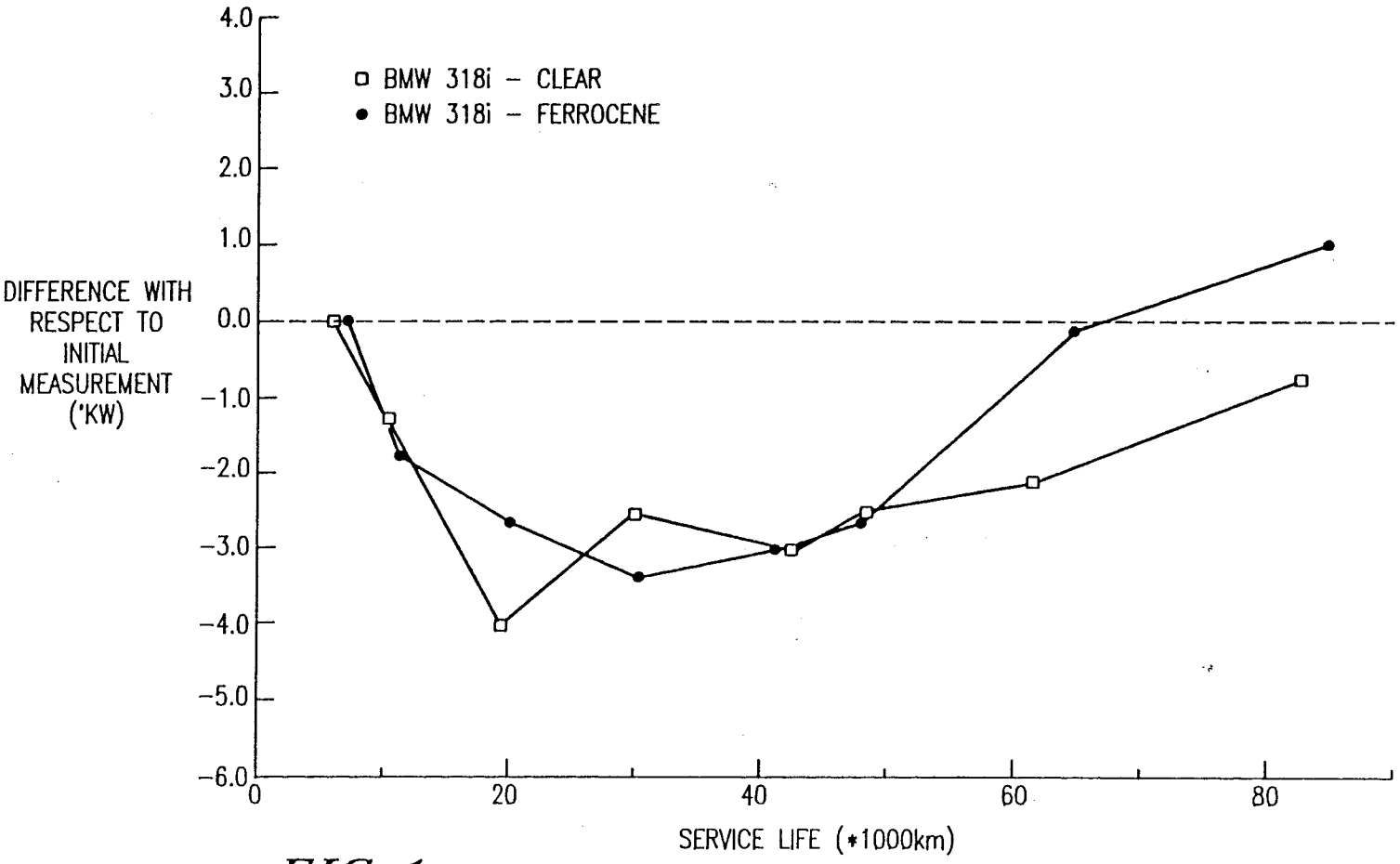
FIGS. 1-9 illustrate the unexpected reduction in exhaust valve wear, decreased emissions and increased fuel efficiency of Otto engines having an exhaust gas catalyst system, operated with unleaded liquid fuel containing ferrocene compared with a similar vehicle operated with a reference fuel which did not contain ferrocene.

The positive effects of a ferrocene addition are attained when ferrocene is added to the unleaded fuel in quantities ranging from 1 to 100, preferably from 5 to 20 ppm by weight. The ferrocene, may be blended directly into the fuel, due to its good solubility in the quantities required. It is preferable to prepare a concentrate of ferrocene that is dissolved in the liquid fuel (unleaded gasoline), an alcohol, an ether, an aromatic solvent or mixtures thereof and the like. Then, from this concentrate the required volume is added to the fuel in order to obtain the desired concentration of ferrocene.

Surprisingly the liquid fuel to which ferrocene had been added resulted in lower fuel consumption, lower emissions, and less mechanical wearing, under operating conditions in field tests while operating an Otto engine equipped with a controlled catalyst system. The standard vehicles used in the field tests were equipped with a controlled catalyst system, built on a one-piece carrier with a coat of catalytically effective metals.

The unleaded liquid fuel of the present method to which ferrocene is added, should have the minimum requirements for unleaded carburetor fuels for Otto engines defined in DIN 51 607 (latest update issue June 1985). DIN 51 607 specifies for unleaded gasolines the following octane ratings:

| | | |
|---|---|---|
| regular gasoline: | research octane no. | 91.0 |
| | motor octane no. | 82.5 |
| premium gasoline: | research octane no. | 95.0 |
| | motor octane no. | 85.0 |

Any unleaded gasoline fuel meeting these minimum requirements is considered to be useful in the present process. The present invention is not directed toward petroleum hydrocarbon fuels for use with diesel engines or for petroleum hydrocarbon fuels used as heating fuels in the heating of buildings, homes, etc.

In the method of the present invention, the Otto engine may be equipped with any conventional exhaust gas catalyst system useful for secondary combustion of exhaust gases. Such catalytic converters are typically constructed of a ceramic support material and coated with a catalytically active material, typically noble metals and/or metal oxides such as platinum and rhodium. The noble metals accelerate the chemical degradation of the toxic carbon monoxide, hydrocarbons and nitrogen oxides. Any of the conventionally used noble metals and/or metal oxides may be used in the present process.

A catalytic converter which degrades all three of the substances is known as a "three-way" catalytic converter. The ceramic support material is typically a honeycomb-structure coated with the noble metal. As exhaust gas flows through this honeycomb structure, the noble metal accelerate the chemical degradation of the carbon monoxide, hydrocarbons and nitrogen oxides. Such catalytic converters are well known in the art (see for example "Mechanical Gasoline Fuel-Injection System With Lambda Closed-Loop Control, K-Jetronic", Bosch Technical Instruction Manual).

Only lead-free gasolines may be used in conjunction with these catalytic converters, since the anti-knock compounds contained in leaded gasoline destroy the catalytic properties of the noble metal catalyst. Lead-free gasoline is a prerequisite for employing catalytic converters of this type and is required for the process of the present invention.

Engines (Otto engines), and in particular automobile Otto engines which may be used in the process of the present invention include any four cycle spark ignition engine which may be operated on unleaded liquid fuel without damage to the mechanical operation of the engine. Suitable examples of typical cars, which must be operated with unleaded gasoline for Otto engines according to DIN 51 607 are the car models enumerated in the "Bleifrei-Liste" list of car types produced by German manufacturers from September, 1985 and issued by the Association of Automobile Manufacturers E. V. (VDA). Cars listed in part A of this reference are German car models which must be operated with unleaded gasoline. Cars listed in part B are models which can be operated without further precautions with unleaded gasoline according to DIN 51 607. Models in part B include engines without catalytic after treatment (catalytic converters) but which are designed for subsequent installation of catalytic converters. The car models listed in parts A and B and fitted with an exhaust gas catalyst system for secondary combustion of the exhaust gas may be utilized in the process of the present invention. Obviously, Otto engines equipped with an exhaust gas catalyst system, in addition to those produced by German manufacture, are considered to be within the scope of the present invention.

Engines and cars equipped with engines which require the use of leaded gasoline either continuously or intermittently to prevent wear of the exhaust valves are unsuitable for use with the present method. Such engines are described in part C of the "Bleifrei-Liste" noted above and include engines which require the use of leaded fuel at least at every third to fifth tank of fuel. Such cars are outside the scope of the present invention.

Other features of the invention will become apparent according to the following descriptions of the exemplary embodiments which are given for illustration of the invention and are not intended to be limiting thereof.

EXAMPLES

A test program using a 1-cylinder engine fitted with a pressure-instrument showed a reduction in the so-called cycle variations when the engine ran on a fuel to which ferrocene had been added. Transferred to the operating behavior of full engines, one can infer from this a more uniform engine operation and better utilization of fuel as well as better possibilities to optimize the combustion process.

The invention is explained in detail with the aid of FIGS. 1 to 8 in which the test programs and the results from two standard upper middle class vehicles, equipped with an exhaust gas catalyzer and lambda probe, over the service life of 80,000 km are documented in field tests under typical road traffic conditions. Both vehicles were operated with the same reference fuel, with the one difference that one vehicle was operated with the reference fuel having the ferrocene additive. The fuel with the ferrocene additive was used in a ferrocene concentration of 15 ppm by weight for the entire test program.

FIG. 1 compares the increase in octane number requirement in the engines of both test vehicles. The results are expressed as advancement in degrees of the crank angle, based on the service life (km) and was measured with the same reference fuel. The results show no significant difference in both engines, however, the increase in octane number requirement improves slightly after approximately 50,000 km of service life for the engine drive with ferrocene.

Figure 2:
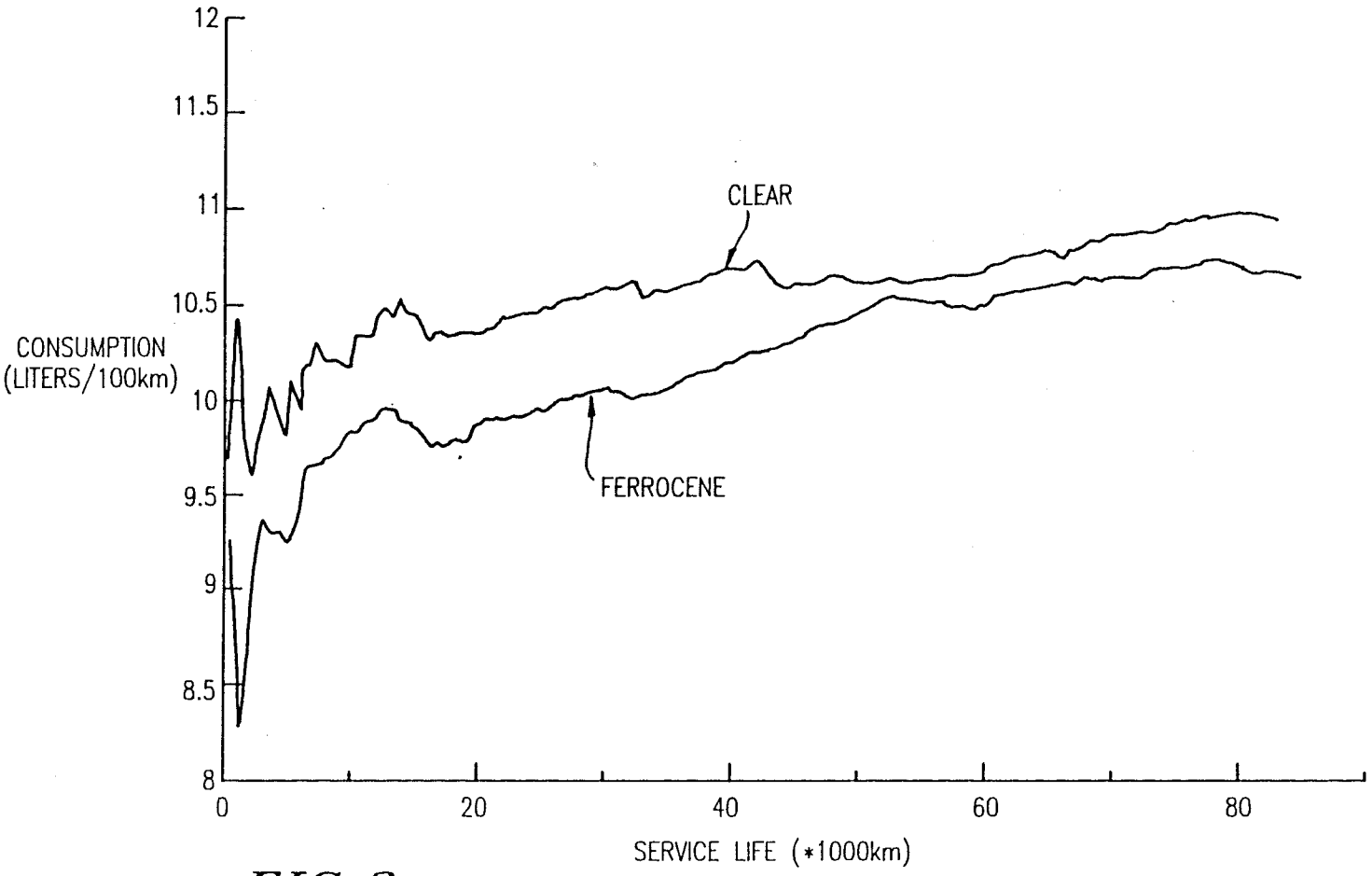

FIG. 2 is a comparison of the fuel consumption values for both test vehicles. The values show that the vehicle driven with ferrocene definitely consumes less fuel.

Figure 3:
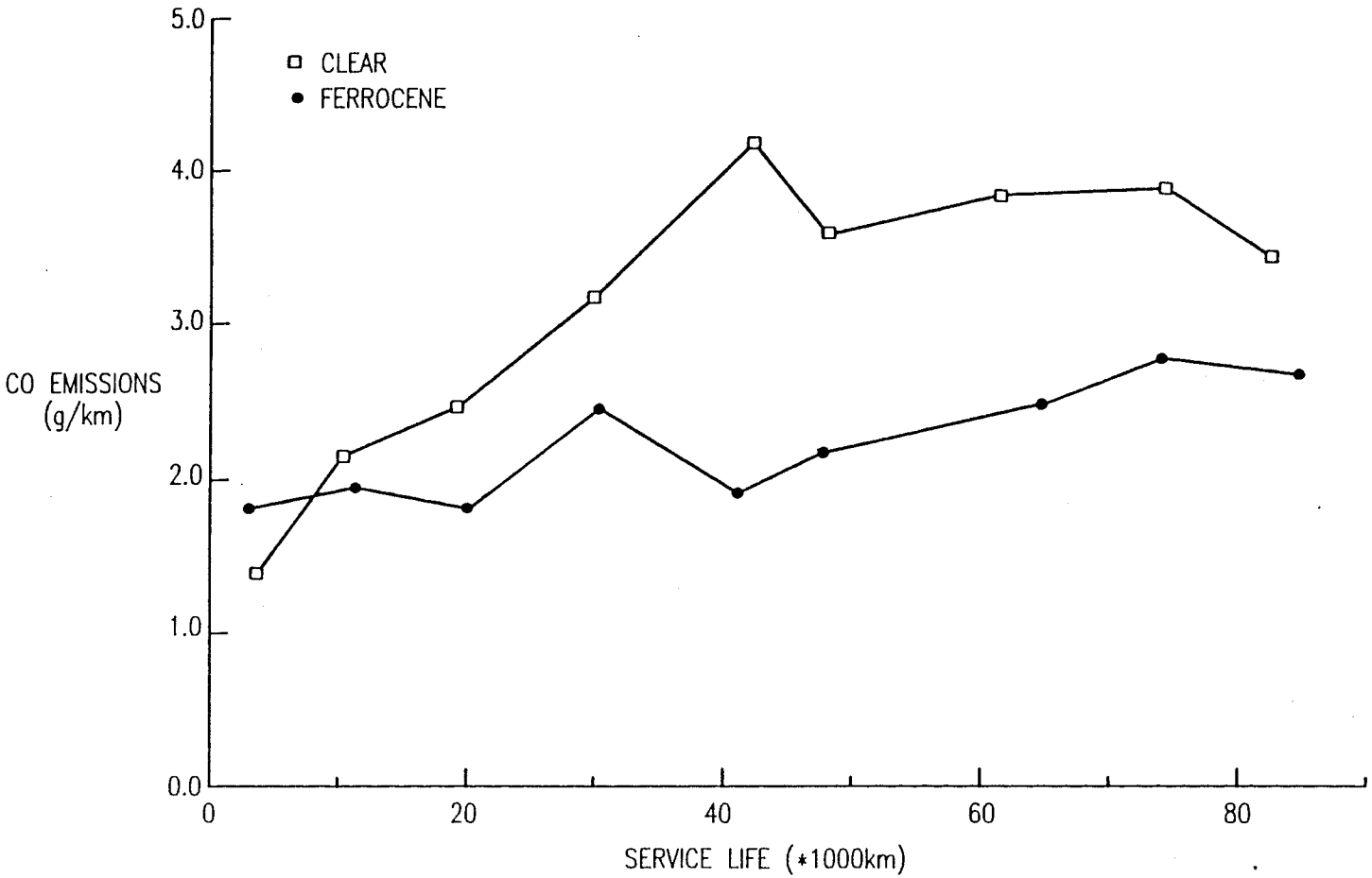

FIG. 3 shows the emission of CO, measured according to the standardized measuring method in the so-called FTP cycle. The emission of carbon monoxide of the vehicle driven with ferrocene is definitely less.

Figure 4:
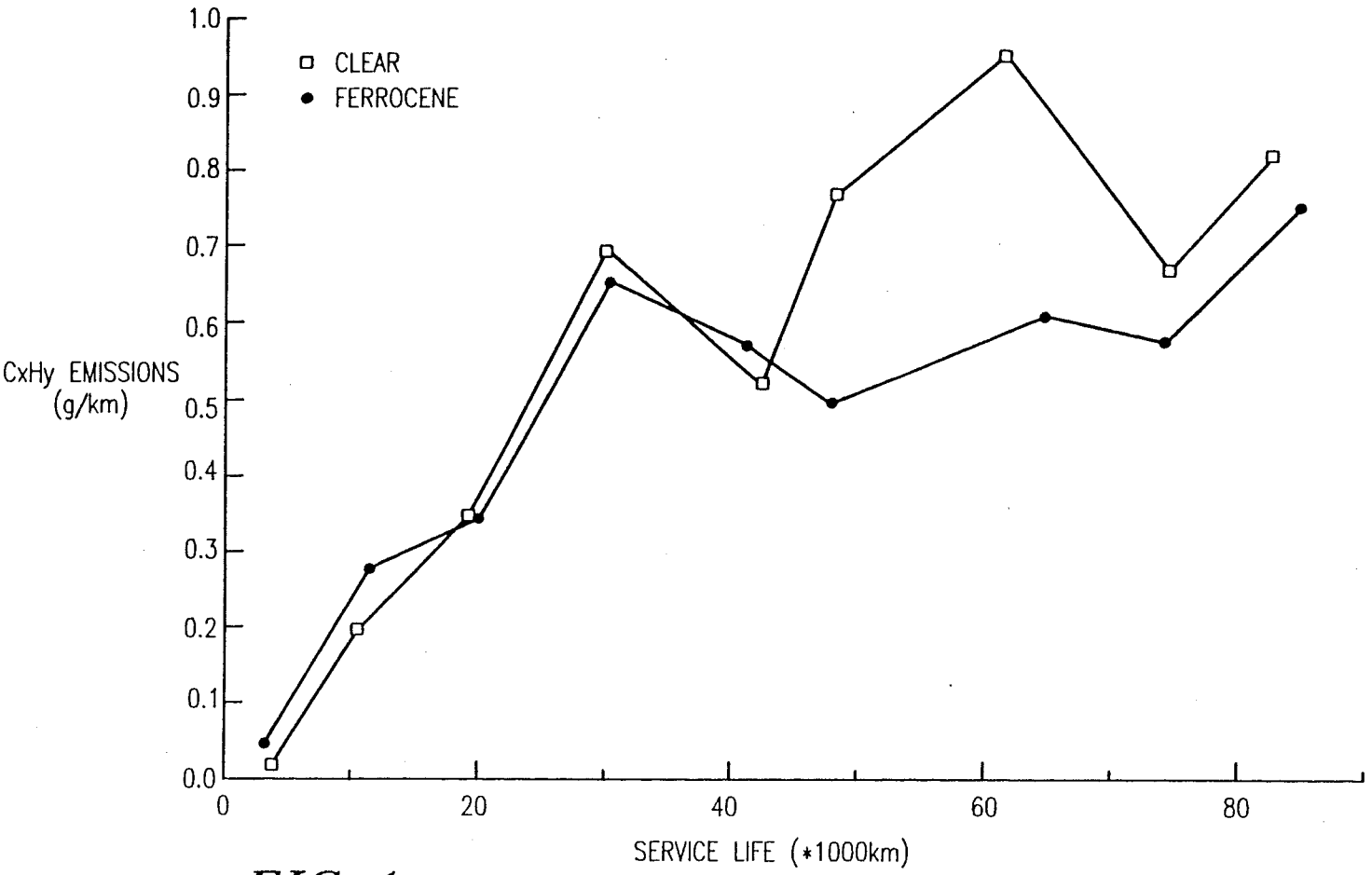

FIG. 4 shows that less hydrocarbons ($C_xH_y$) are emitted after approximately 40,000 km of service life by engines driven with a fuel to which ferrocene has been added.

Figure 5:
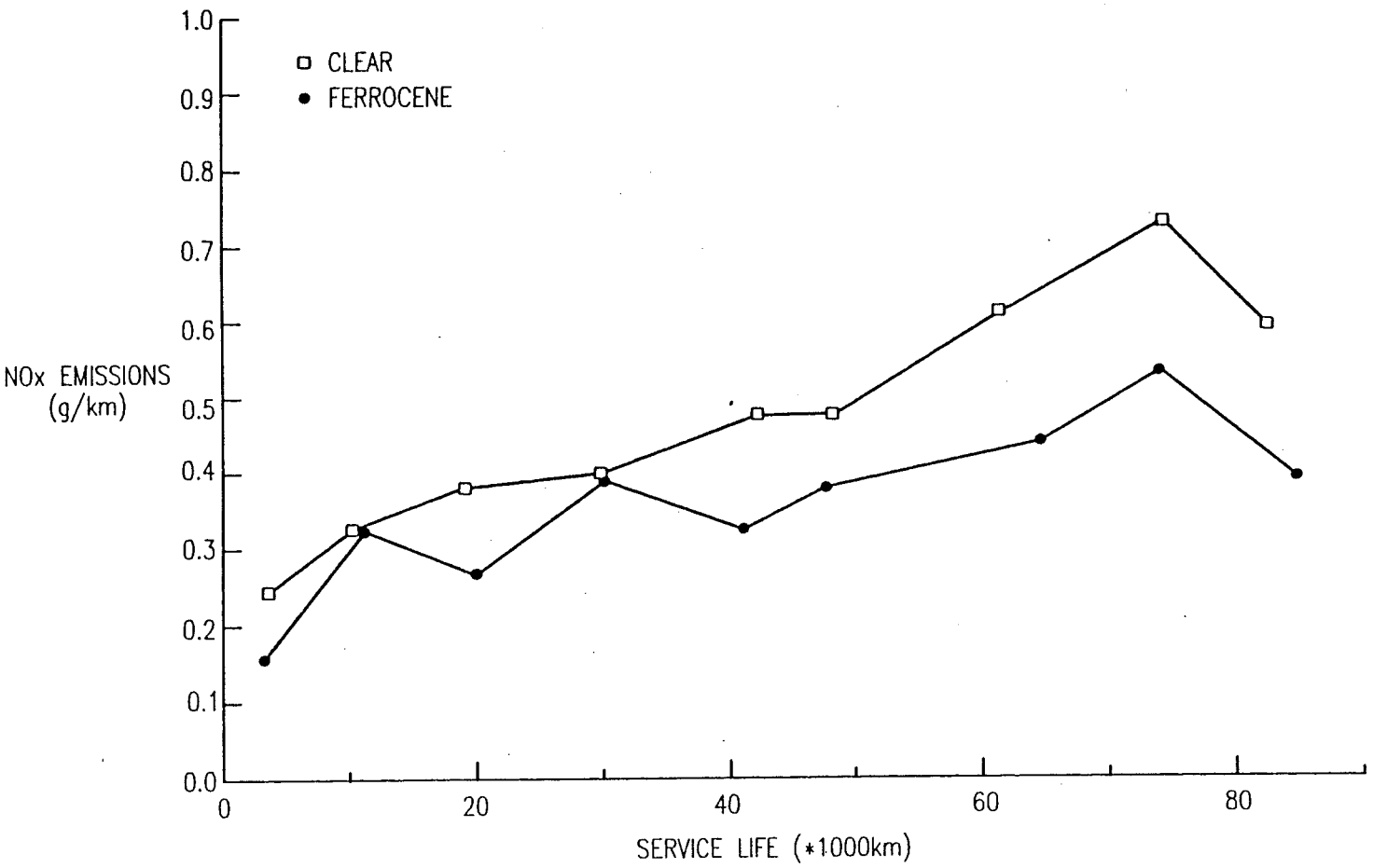

FIG. 5 documents a definite reduction in $NO_x$ emissions.

Figure 6:
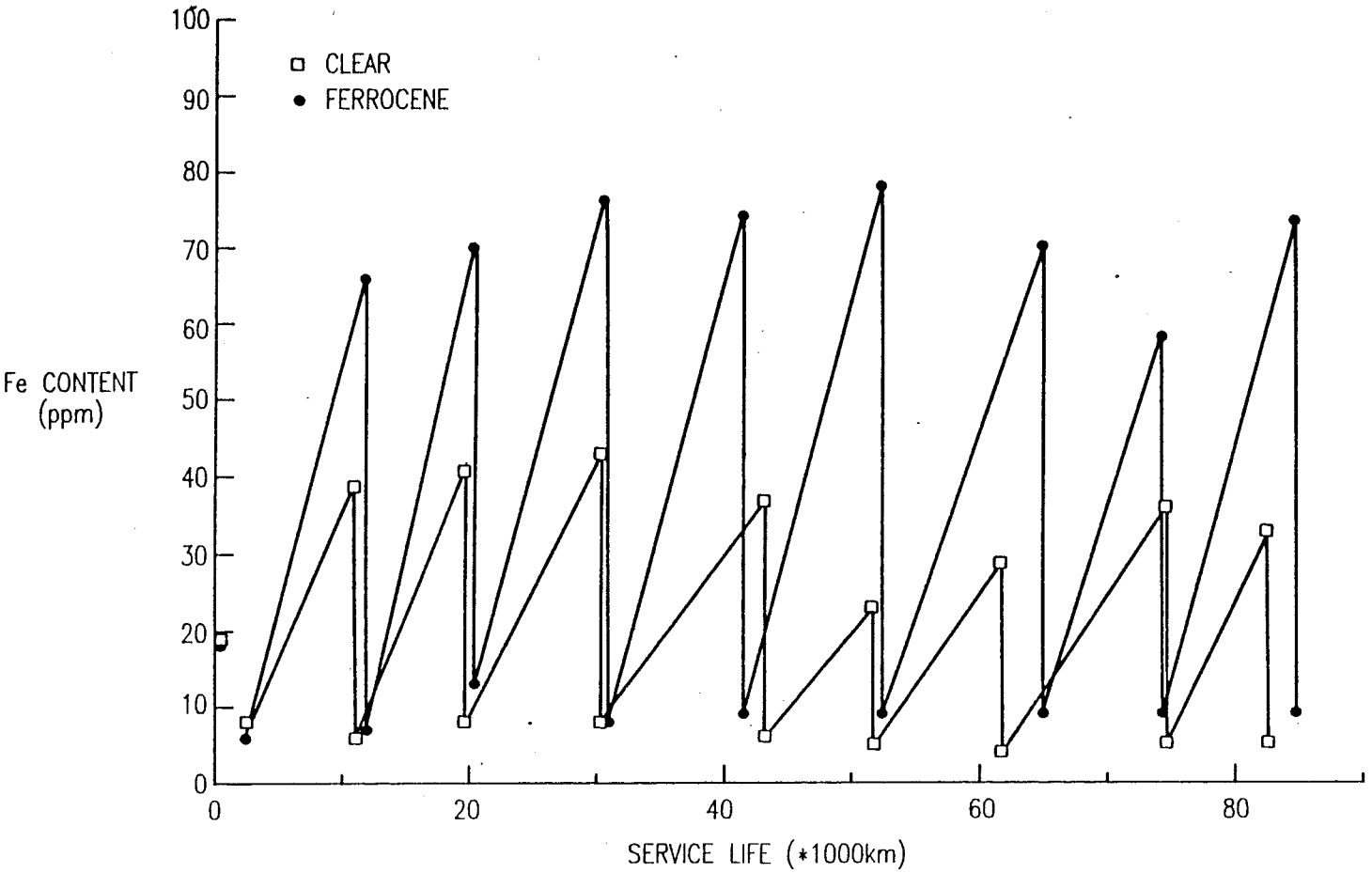

FIG. 6 shows the results of an analysis of lubricants, used in both vehicles, on wearable elements. The measured values were determined from so-called zero samples (low values) immediately after the oil change and from the final samples, which were taken at the end of the oil change interval and analyzed.

This figure shows that, as expected, the element iron, especially interesting with the addition of ferrocene to the fuel, (analyzed as Fe) is higher when operating on the additive-containing fuel; however, no increase over the service life is observed.

Figure 7:
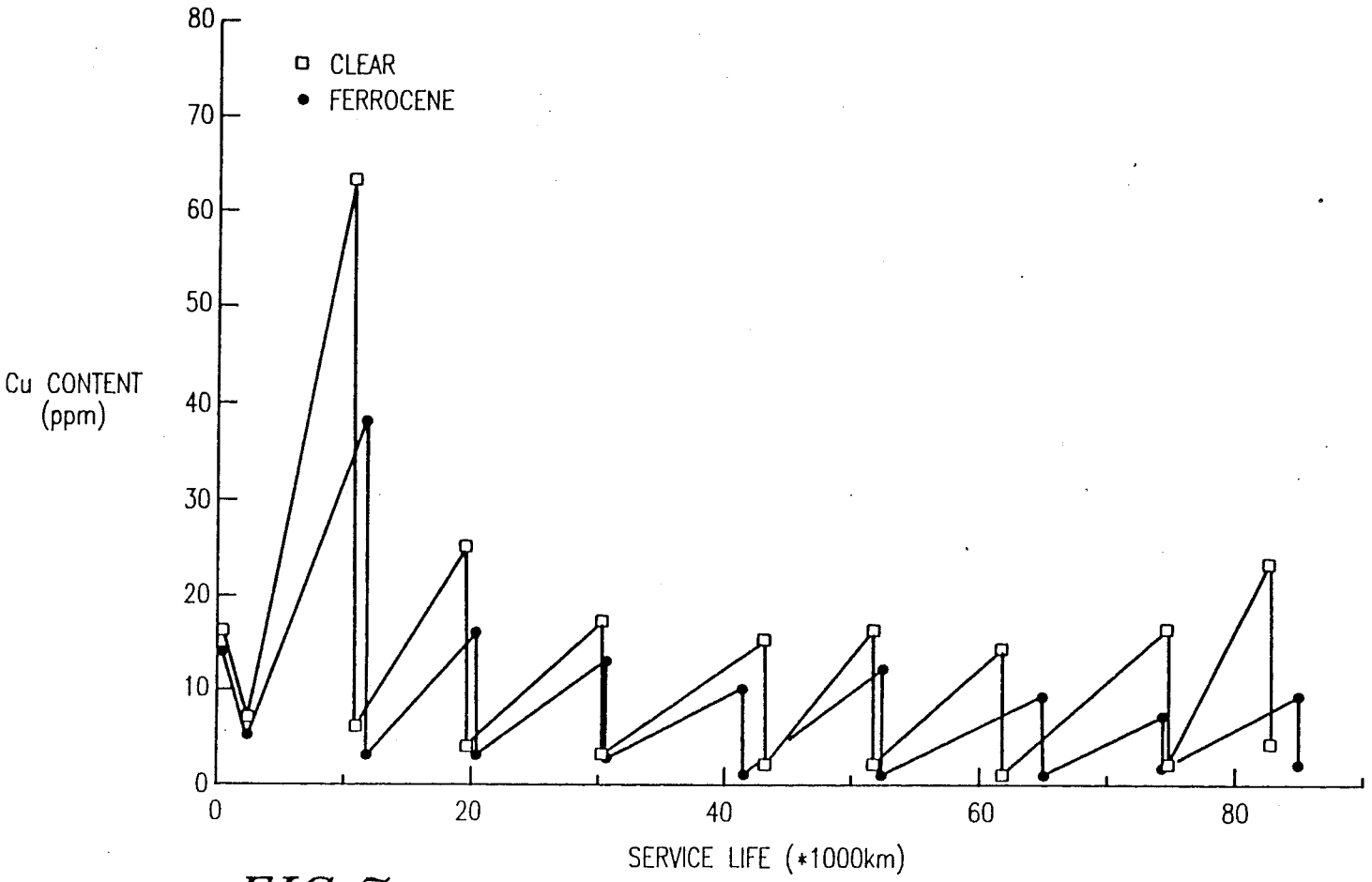

FIG. 7 is another example of the wearable elements, analogous to the measured results in FIG. 6, for the element copper Cu, whereby the Cu contents of the final samples of lubricant, taken from the vehicle driven with a fuel to which ferrocene has been added, show lower values over the entire service life.

Figure 8:
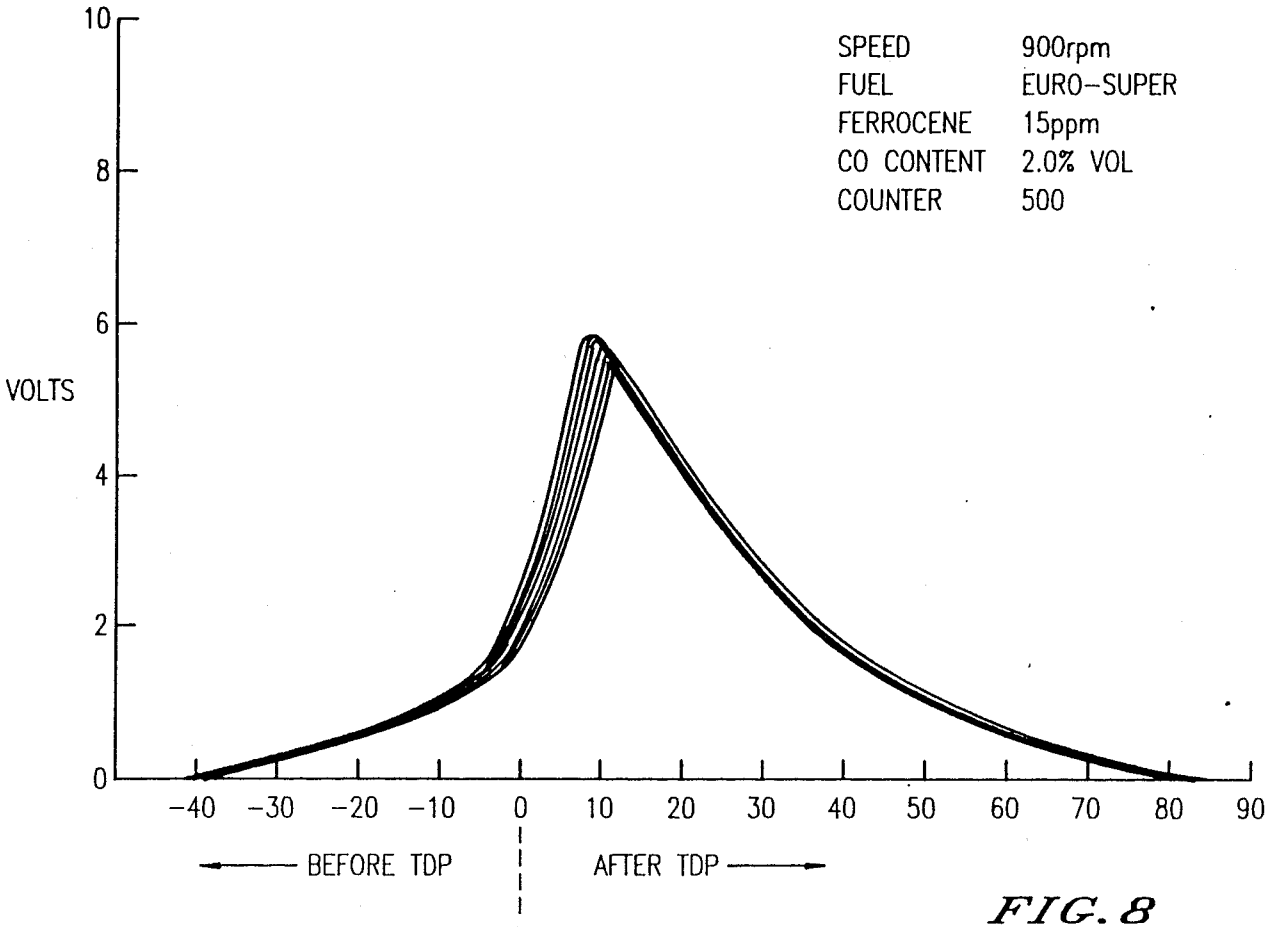
Figure 9:
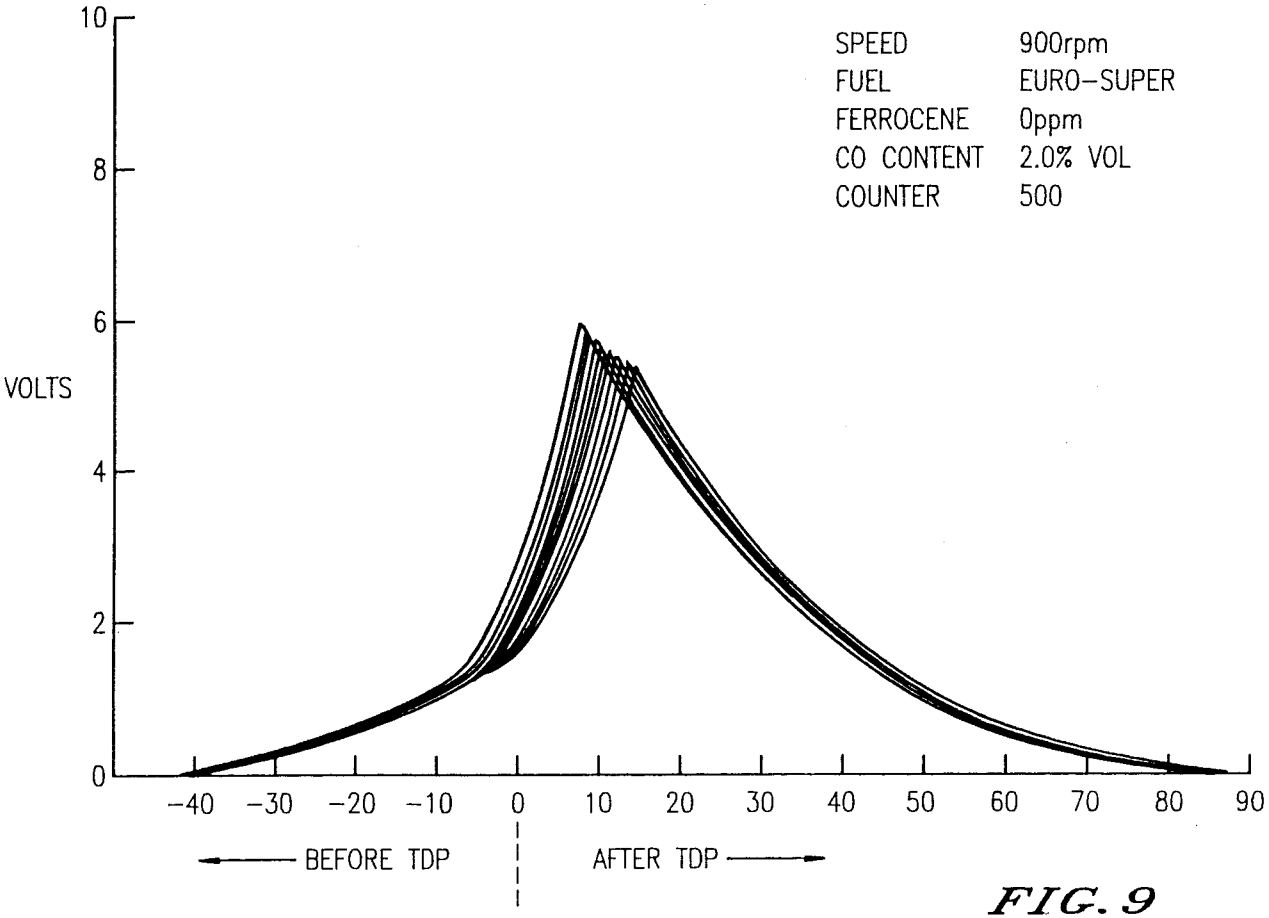

FIGS. 8 and 9 show the pressure curve of a pressure-instrumented 1-cylinder engine as the test engine. The family of curves, shown in FIG. 8, show approximately 30 combustion patterns with ferrocene-added fuel and the family of curves, shown in FIG. 9, show the corresponding characteristics without the addition of ferrocene under otherwise identical operating conditions. It is clear that a definite comparability of the cycle variations and thus better conditions for operating the engine and utilizing the fuel is brought about by ferrocene.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the U.S. is:

1. A method for operating an engine, comprising:

operating an Otto engine equipped with an exhaust gas catalyst system for secondary combustion of exhaust gas, with a non-leaded liquid fuel containing 1 to 100 ppm by weight of ferrocene.

2. The method of claim 1, wherein said non-leaded fuel contains 5–20 ppm by weight of ferrocene.

3. The method of claim 1, wherein said exhaust gas catalyst system comprises a controlled catalyst system wherein a support material is coated with a noble metal, a metal oxide or mixture thereof.

4. The method of claim 3, wherein said noble metal is platinum or rhodium.

5. The method of claim 3, wherein said support material is a ceramic material.

6. The method of claim 1, wherein said non-leaded liquid fuel meets the minimum octane requirements defined in the German Industrial Standard DIN 51 607.

* * * * *